US005421375A

United States Patent [19]

Praetzel

[11] Patent Number: 5,421,375

[45] Date of Patent: Jun. 6, 1995

[54] EIGHT HARNESS DOUBLE LAYER FORMING FABRIC WITH UNIFORM DRAINAGE

[75] Inventor: Michael D. Praetzel, Anderson, S.C.

[73] Assignee: Wangner Systems Corporation, Greenville, S.C.

[21] Appl. No.: 202,571

[22] Filed: Feb. 28, 1994

[51] Int. Cl.[6] ..... D03D 15/00

[52] U.S. Cl. ..... 139/383 A; 139/425 A

[58] Field of Search ..... 139/383 A, 425 A

[56] References Cited

U.S. PATENT DOCUMENTS

| | | | |
|---|---|---|---|
| 2,288,512 | 6/1942 | Buchanan . | |
| 3,167,281 | 1/1966 | Hill . | |
| 4,379,735 | 4/1983 | MacBean | 139/425 A |
| 4,611,639 | 9/1986 | Bugge . | |
| 4,636,426 | 1/1987 | Fleischer . | |
| 4,934,414 | 6/1990 | Borel | 139/383 A |
| 4,941,514 | 7/1990 | Taipale | 139/383 A |
| 4,998,568 | 3/1991 | Vohringer | 139/383 A |
| 5,164,249 | 11/1992 | Tyler et al. | 139/383 A X |
| 5,244,543 | 9/1993 | Fry | 139/383 A X |

*Primary Examiner*—Andrew M. Falik
*Attorney, Agent, or Firm*—Henry S. Jaudon; Cort Flint

[57] ABSTRACT

A method of weaving on a loom a multilayer paper forming fabric in an eight warp repeating pattern. The weaving is controlled to produce uniform drainage channels throughout the forming fabric. The paper forming fabric is formed to have a weft yarn dominant paper support surface and a weft yarn dominant running surface. The loom includes a reed which has a plurality of reed teeth which form dents. A single layer of side-by-side warp yarns are arranged through the dents of the reed so that each warp yarn engages with at least one reed tooth. A weft yarn of a first layer of weft yarns is woven with the warp yarn to form the weft dominant paper support and a weft yarn of a second layer of weft yarns is woven with the warp yarn to form the weft dominant running surface. Each pick of weft yarn of the first and second layers of weft yarn is beaten-up by the reed to be substantially evenly spaced throughout said paper forming fabric by controlling each warp yarn during beat-up with at least one reed tooth and by controlling each weft yarn adjacent each formed warp knuckle. The process produces uniform and consistent crimps which provide for uniform drainage channels throughout.

12 Claims, 3 Drawing Sheets

EIGHT HARNESS DOUBLE LAYER FORMING FABRIC WITH UNIFORM DRAINAGE

BACKGROUND OF THE INVENTION

This invention is directed to a method of weaving an eight harness double-layer forming fabric woven to have uniform drainage channels along the fabric length and across its width.

Eight harness forming fabrics are themselves not novel and have been used throughout the paper forming industry for some time with questionable success. The eight harness double-layered weave structure is durable and can be woven with ample drainage capacity. The drawback with this weave pattern for forming fabrics is that, up until now, the inability to form the drainage channels to be uniform across the width and along the length of the fabric. Various attempts have been made to weave forming fabrics having uniform warp-weft displacement with the same harness weave pattern. None to date have been successful.

Accordingly, it is an object of this invention to weave a multilayered forming fabric having uniform drainage channels both along its length and across its width.

Another object of the invention is to provide a method of weaving a multilayered forming fabric having stacked weft yarns in which the weft yarns remain vertically stacked.

Another object of the invention is the provision of controlling each pick of weft yarn during beat-up to form precise and defined knuckles in the warp capable of maintaining the weft in the position in which it is beaten up.

Another object of the invention is to provide an improved method of weaving multi-layered forming fabric having weft dominant support and running surfaces.

Another object of the invention is a method of weaving an eight harness double layered forming fabric on a loom in which the warp yarns are reeded through the reed at two per dent.

SUMMARY OF THE INVENTION

The above objectives are accomplished according to the invention by weaving a stable multilayer paper forming fabric with a weft yarn dominant running surface and a weft dominant support surface. The forming fabric has an upper weft yarn layer and a lower weft yarn layer which are each woven with a single layer of warp yarns. The weft yarns of the lower weft yarn layer are woven to be vertically stacked with the weft yarn of the upper layer. The method of weaving includes a loom having reed teeth forming dents with the reed teeth being arranged across the reed width. The warp yarns are reeded through the reed teeth at two per dent. The warp yarns are maintained in parallel relationship during beat-up because each warp yarn is engaged continuously by a reed tooth during weaving.

The weft yarns are controlled by the reed teeth during beat-up to be positioned in substantially parallel relationship and to form pronounced and consistent crimps in the warp yarns. This is accomplished by engaging each weft along its length at a point adjacent to each warp yarn by reed teeth during beat-up. The pronounced crimps in the warp yarns act to engage with and maintain the substantially parallel upper and lower weft yarns vertically stacked.

The weave requires the use of eight harnesses for the shedding of the warp yarns. The weave pattern is a twenty-four pick repeating pattern. Preferably, the weft yarns maybe of two different diameters in the upper layer of weft yarns with the lower layer weft yarns being of a single diameter. Alternatively, they all may be of one diameter.

The method includes preferably forming the weft and warp yarns of polyester. Obviously other materials such as polyamide may be used. Also, the weft and warp yarns are of a diameter of between 0.10 mm and 0.80 mm, depending on the application of the fabric.

The method includes weaving the forming fabric on the loom with the paper-support or upper surface being formed on the upper side of the fabric and the running or lower surface being formed on the lower surface of the fabric.

The multilayer forming fabric of the invention is an eight warp yarn repeating weave pattern in which each of the weft yarns of the upper weft yarn layer pass over at least six of the warp yarns of each warp repeat. By so controlling the warp/weft relationship, a forming fabric having a weft dominant support surface is formed. Also, the eight warp yarns of the warp yarn repeating weave pattern are woven with the weft yarn forming the lower weft yarn layer so that each of these weft yarns pass under at least six of the warp yarns of each warp repeat to form a weft dominant running surface.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

The method designed to carry out the invention will hereinafter be described, together with other features thereof.

Referring now in more detail to the drawings, the invention will now be described in more detail.

In paper making, a paper forming slurry is deposited on the support surface of a paper forming fabric to be de-watered formed into paper. The process requires that the paper forming fabric be porous to allow the liquid of the slurry to pass through the forming fabric in a continuous and uniform manner. During this forming process, the paper forming fabric will leave markings on the paper. In order that these markings be uniform over the whole paper, it is necessary for the warp yarns and the weft yarns forming the paper forming fabric to be equally spaced in substantially parallel relationship across the width and along the length of the fabric. This will not only result in uniform marks on the paper, but also, it will bring about even drainage of the slurry liquid through the forming fabric. Even drainage is necessary in order to prevent blemishes from being formed on the paper.

It is a common practice to form paper forming fabrics with a weft dominant running or machine side surface. This is because the running surface is that surface which comes into contact with the support rollers of the paper forming machine and is therefore the surface subject to the most wear. Also, normally most stress applied to the paper forming fabric is in the machine direction or in the warp direction. By protecting the warp against wear of the life of the paper forming fabric is greatly increased.

Usually, the warp and weft yarns are formed of synthetic monofilaments formed of a polyester as it is essential that the fabric not stretch in use. The weft yarns which are not subject to as much tension as the warp yarns may alternately be formed of a more wear resistant yarns such as yarns of polyester-polyamid blends, polyester polyurethane blends or similar core yarns. Certain multi-layer weave patterns provide that the paper support surface be woven in a weft dominant pattern. This arrangement produces a paper support surface of predominantly cross machine yarns for supporting the paper machine oriented fiber.

Figure 1:
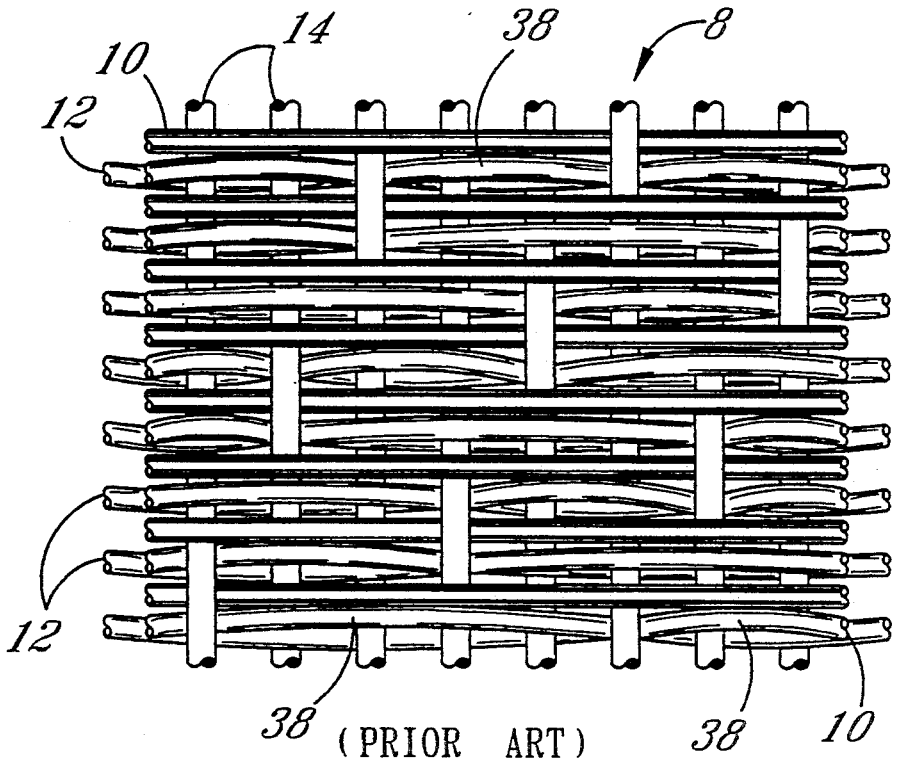
FIG. 1 is a sectional top view of a prior art form of the invention.

A weave pattern for weaving a paper forming fabric having the above characteristics is shown in FIG. 1 of the drawings.

In FIG. 1, the support surface of a double layered dryer fabric 8 according to the prior art is shown. As indicated, the support surface is formed with each pick of the weft yarn floating over, in most instances six of the eight warp yarns and in certain instances over seven of the eight warp yarns. The opposite side of the fabric is the running surface. Here each pick of weft yarn floats over six of the eight warp yarns per pattern repeat. As can be seen in FIG. 1, there are no clear or well defined drainage channels due to the uneven and non-parallel positions of the weft yarns 10 and 12.

It is normal to reed the warp yarns through the reed dents of the loom at four per dent and sometimes six per dent when weaving paper forming fabrics. This is done because due to the diameter and stiffness of the warp yarns, it is difficult and time consuming to draw the warp into the reed with fewer of these yarns per dent. Also, the greater the number of reed teeth, the smaller each tooth must be. The smaller teeth wear more quickly reducing the life of the reed. They also produce a less stable reed.

Figure 8:
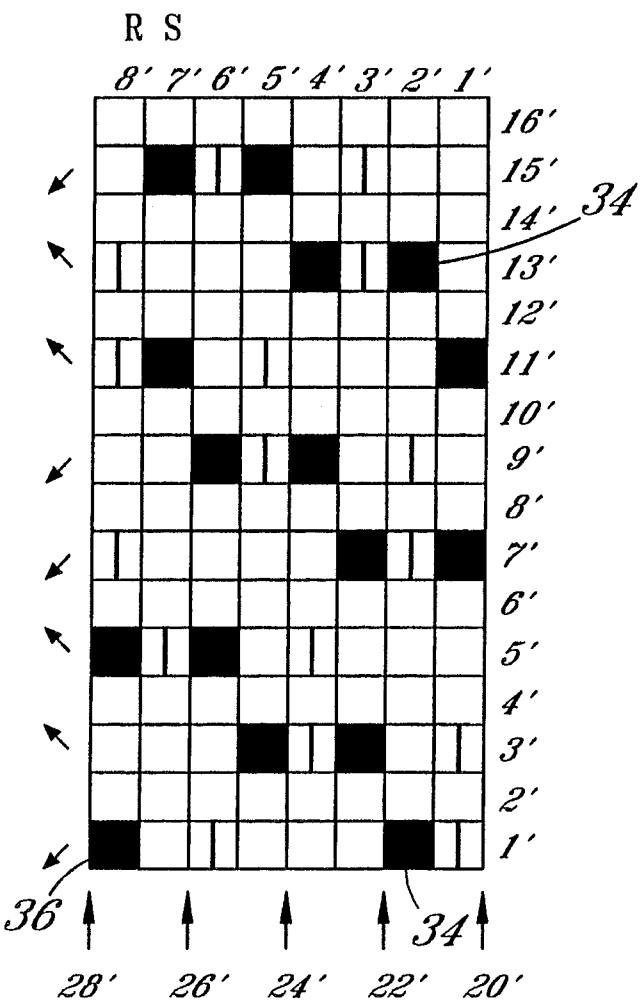
FIG. 8 is the weave diagram of the paper forming fabric of the invention taken from the running surface side.

Weaving the instant weave pattern with the warp reeded at four per dent would allow for only two reed teeth to engage each pick of weft yarn along its length over a single repeat of the pattern. More particularly, weaving the pattern shown in FIG. 7, pick 1 would be controlled only adjacent to warps 1 and 8 by reed 20 and adjacent warps 4 and 5 by reed 24. This means that between warps 1–4 and warps 5–8, no control is had of the yarn forming pick 1 during beat-up. Each of the remaining fifteen picks are similarly controlled during beat-up. FIG. 8 shows the same lack of control along the length of pick 1 for the running surface during beat-up. The result of this lack of control produces warp knuckles as at 30 in FIG. 7 and as at 34 in FIG. 8 which lack uniformity and are very weak. These weak and non-uniformed warp knuckles allow the weft yarns, which are stacked yarns, to slip to one side or the other of each other in a non-uniform manner as shown at 38 in FIG. 1. More specifically, weft yarns 10 are shown to have moved oppositely of the lower or running surface weft yarns 12, filling and altering the drainage channels. Clearly, the drainage channels formed in the fabric cannot be uniform across or along the fabric length.

Figure 3:
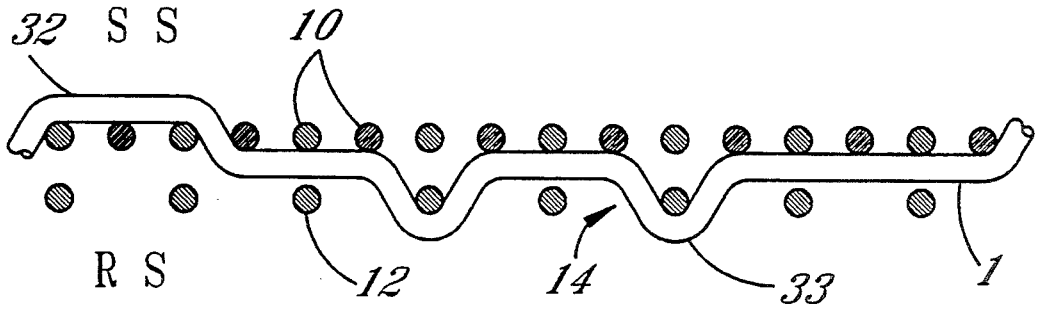
FIG. 3 is a side sectional view showing the path of a warp through the weave pattern. The running surface is shown in the lower position.
Figure 4:
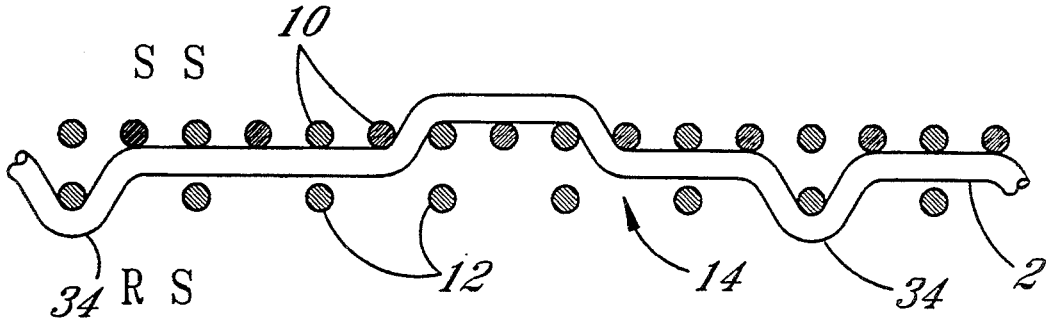
FIG. 4 is similar to FIG. 3 showing the path of a second warp through the weave pattern.
Figure 5:
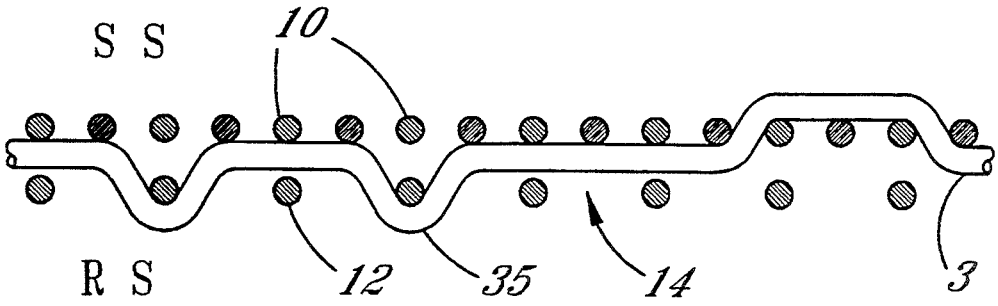
FIG. 5 is similar to FIG. 3 showing the path of a third warp through the weave pattern.
Figure 6:
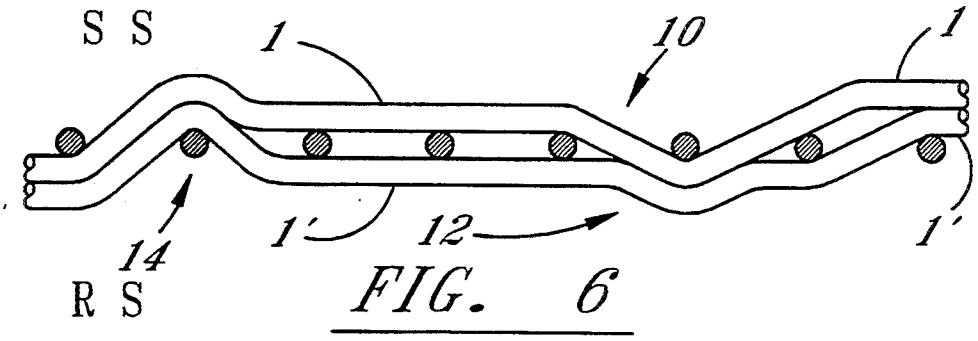
FIG. 6 is a sectional end view showing the path of an upper and lower weft yarn through the weave pattern.
Figure 7:
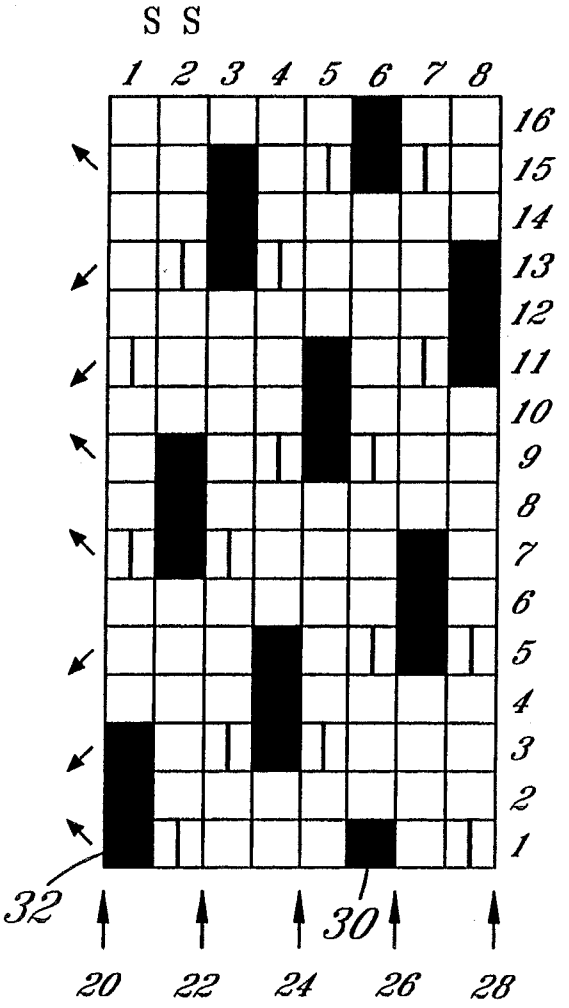
FIG. 7 is the weave diagram of the paper forming fabric of the invention taken from the support surface side.

According to the invention, it has been found that by reeding the warp yarns at two per dent, as shown by reed teeth 20, 22, 24, 26 and 28 in FIGS. 7 and 8, each pick of the weft yarn 10 or 12 is controlled more precisely along its length during beat-up. The more closely spaced reed teeth 20–28 engage with each pick at a point adjacent to a warp yarn. Because the weft yarn 10, 12 of each pick is positively controlled adjacent to a warp yarn, that warp yarn is better controlled. Where the warp is shed to form knuckles as at 34 and 36 in FIGS. 4 and 8, more precise, consistent and well defined knuckles or crimps are formed. FIGS. 3 and 5 show well defined knuckles formed in the first and third warp yarns 14. These well defined knuckles act to hold the weft yarns 10, 12 in the transverse position into which reed teeth 20-28 have beaten them up. This allows the stacked weft yarns, as shown in FIGS. 3 and 4, to maintain their relative position.

The fabric and process of the invention will now be more fully described.

FIGS. 7 and 8 show the weave diagram which produces the forming fabric of the invention in which the weft is dominant on both faces. The weave pattern requires a single layer of warp yarns 14 shown as warps 1, 2, 3, 4, 5, 6, 7, 8 and two layers of weft yarns 10, 12 with the support or upper surface layer requiring picks 1–16 and the running or lower surface requiring eight picks 1', 3', 5', 7', 9', 11', 13' and 15'.

Referring now to FIG. 7, it can be seen that warp 1 of the weave pattern weaves over picks 1–3 and beneath picks 41–6. Warp 1 also weaves below picks 7' and 11' but above picks 1', 3', 5', 9', 13' and 15'. Warp 2 weaves below picks 1' 13', below picks 1–6, 10–16 and above picks 7–9 and 3', 5', 7', 9', 11', and 15'. Warp 3 weaves below picks 3', 7', below picks 12, 16 above picks 1', 5', 9', 11', 13', 15', 13, 14 and 15. Warp 4 weaves below picks 9' and 13', below picks 1, 2, 6–16, above picks 1', 3', 5', 7', 11', 15', and picks 3, 4, and 5. Warp 5 weaves below picks 3', 15', below picks 1–8, 12–16, above picks 1', 5', 7', 9', 11', 13', and above picks 9–11. Warp 6 weaves below picks 5', 9', below picks 2–14, above picks 1', 3', 7', 11', 13', 15', and above picks 1, 15, and 16. Warp 7 weaves below picks 11', 15', below picks 1–4, 8–16, above picks 5–7 and above picks 1', 3', 5', 7', 9', 13'. Warp 8 weaves below picks 1', 5', below picks 1–10, 14–16, over picks 11–13 and over picks 3', 7', 9', 11', 13', and 15'.

As shown, warps 1 and 2 are reeded between reed teeth 20, 22; warps 3 and 4 between reed teeth 22, 24; warps 5 and 6 between reed teeth 24, 26; and warps 7 and 8 between reed teeth 26, 28. This arrangement causes at least one reed tooth to be in engagement with each warp yarn during the entire weaving process which maintains the warp yarns parallel. The reed teeth contact the weft at short spaced intervals to maintain the weft along an axial path during beat-up. Also, where each knuckle or crimp is formed in the warp yarns, a reed tooth such as 20 and 26 is in direct contact with both the warp and weft yarn, thereby creating deeper, better defined and more uniform warp knuckles such as at 32, 33, 34, and 35 in FIGS. 3–5.

Figure 2:
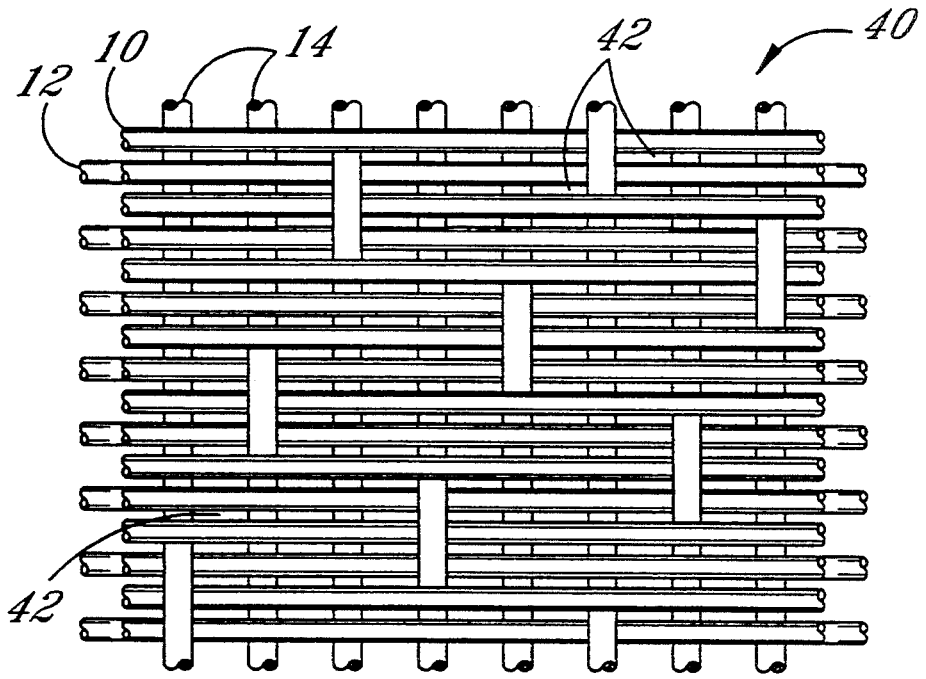
FIG. 2 is a sectional top view showing the warp/weft relationship of the paper forming fabric of the invention.

A multi-layered paper forming fabric 40, as shown in FIG. 2, is the result of weaving with the warp yarns 14 reeded at two per dent. As can be seen, upper weft yarns 10 remain superimposed over lower weft yarns 12 forming uniform drainage channels 42 which extend both in the machine direction and in the cross machine direction. Because the weft yarns maintain their positions, the channels are of uniform size.

While a preferred embodiment of the invention has been described using specific terms, such description is for illustrative purposes only, and it is to be understood that changes and variations may be made without departing from the spirit or scope of the following claims.

What is claimed is:

1. A method of weaving on a loom a porous multi-layer paper forming fabric having uniform drainage channels throughout, said paper forming fabric having an upper weft yarn layer and a lower weft yarn layer interwoven in a twenty four pick repeating pattern with a single layer of warp yarn to form a weft yarn dominant paper support surface and a weft yarn dominant running surface, certain of said weft yarns of said upper weft yarn layer being woven to be vertically stacked with said weft yarn of said lower weft yarn layer, said method comprising:

providing said loom with a reed having teeth forming a plurality of dents along said reed and arranging said warp yarns with said reed so that no more than two of said warp yarns pass through any one of said dents;

controlling said warp yarns to be in parallel relationship during beat-up by having each warp yarn engaged by a reed tooth during beat-up;

beating-up said weft yarns to be positioned in substantially parallel relationship, and forming consistent and well defined crimps in said warp yarns with said weft yarns during beat-up by engaging each weft yarn along its length adjacent each warp yarn with one of said reed teeth; whereby said consistent and well defined crimps in said warp yarns act to engage with said substantially parallel upper and lower weft yarns to maintain them parallel and vertically stacked creating uniform drainage channels.

2. The method of claim 1 including weaving said multi-layer paper forming fabric in an eight warp repeating weave pattern in which each of said weft yarns of said upper weft yarn layer passes over at least six of said warp yarns of said warp repeat to form a weft dominant support surface.

3. The method of claim 1 including weaving certain of said upper weft yarns to pass over seven of said warp yarns of said warp yarn repeat.

4. A method of weaving on a loom a porous multi-layer paper forming fabric having uniform drainage channels throughout, said paper forming fabric having an upper weft yarn layer and a lower weft yarn layer interwoven with a single layer of warp yarn to form a weft yarn dominant paper support surface and a weft yarn dominant running surface, certain of said weft yarns of said upper weft yarn layer being woven to be vertically stacked with said weft yarn of said lower weft yarn layer, said method comprising:

providing eight harnesses for shedding said warp yarns;

providing said loom with a reed having teeth forming a plurality of dents along said reed and arranging said warp yarns with said reed so that no more than two of said warp yarns pass through any one of said dents;

controlling said warp yarns to be in parallel relationship during beat-up by having each warp yarn engaged by a reed tooth during beat-up;

beating-up said weft yarns to be positioned in substantially parallel relationship, and forming consistent and well defined crimps in said warp yarns with said weft yarns during beat-up by engaging each weft yarn along its length adjacent each warp yarn with one of said reed teeth; whereby said consistent and well defined crimps in said warp yarns act to engage with said substantially parallel upper and lower weft yarns to maintain them parallel and vertically stacked creating uniform drainage channels.

5. The method of claim 4 including weaving said multilayer paper forming fabric in an eight warp repeating weave pattern in which weft yarns forming said running surface pass over at least six of said warp yarns of said warp repeat to form a weft dominant running surface.

6. The method of weaving on a loom a multilayer paper forming fabric in an eight warp repeating pattern to have uniform drainage channels, said paper forming fabric having a weft yarn dominant support surface and a weft yarn dominant running surface;

providing said loom with a reed having a plurality of teeth forming dents;

providing a single layer of side-by-side warp yarns and arranging said warp yarns through said reed so that each warp yarn engages with at least one reed tooth;

weaving weft yarn of a first layer of weft yarn with said warp yarn to form said weft dominant running surface and weaving weft yarn of a second layer of weft yarn with said warp yarn to form said weft dominant support surface;

controlling at least alternate weft yarns of said first and second weft layers to be vertically stacked;

forming said uniform drainage channels by beating-up said weft yarn of said first and second layers of weft yarn to be substantially evenly spaced throughout said paper forming fabric by controlling each warp yarn during beat-up with at least one reed tooth.

7. The method of claim 6 including providing at least two diameters of weft yarns for said upper layer of weft yarns.

8. The method of claim 6 including providing said lower layer weft yarns to be a single diameter.

9. The method of claim 8 including providing said upper layer weft yarn be of said single diameter arranged in vertically stacked relationship with said lower layer weft yarns.

10. The method of claim 6 including forming said weft and warp yarns of polyester.

11. The method of claim 6 including providing said warp yarns and said upper and lower layer weft yarns to have a diameter of between 0.10 mm and 0.80 mm.

12. The method of claim 6 including weaving said paper forming fabric on said loom with said running surface being formed on the lower side thereof.

* * * * *